United States Patent [19]

Tominaga et al.

[11] Patent Number: 4,561,657

[45] Date of Patent: Dec. 31, 1985

[54] GOLF BALL

[75] Inventors: Ichiro Tominaga, Kobe; Akihiro Nakahara, Ibaraki, both of Japan

[73] Assignee: Sumitomo Rubber Industries, Ltd., Kobe, Japan

[21] Appl. No.: 576,695

[22] Filed: Feb. 3, 1984

[30] Foreign Application Priority Data

Feb. 3, 1983 [JP] Japan ..... 58-17080

[51] Int. Cl.[4] ..... A63B 37/02; A63B 37/06

[52] U.S. Cl. ..... 273/218; 260/998.14; 273/235 R; 524/300; 524/322; 524/908

[58] Field of Search ..... 273/218, 235 R; 524/322, 908, 300; 260/998.14

[56] References Cited

U.S. PATENT DOCUMENTS 3,763,059 10/1973 Needham et al. ..... 524/322
4,056,269 11/1977 Pollett et al. ..... 273/218
4,165,877 8/1979 Miller et al. ..... 273/218
4,305,851 12/1981 Tominaga et al. ..... 273/218

FOREIGN PATENT DOCUMENTS 57-78432 5/1982 Japan ..... 273/218
1430843 4/1976 United Kingdom ..... 273/218

*Primary Examiner*—Allan M. Lieberman
*Attorney, Agent, or Firm*—Armstrong, Nikaido, Marmelstein & Kubovcik

[57] ABSTRACT

A zinc acrylate powder coated with a higher fatty acid has a good dispersibility into a rubber, and is used as a co-crosslinking agent in rubber compositions for one piece solid golf balls or for cores of covered solid golf balls. The compositions containing the coated zinc acrylate have a good roll workability and provide solid golf balls having an improved impact resilience, a proper hardness and good sound and feeling of striking.

3 Claims, No Drawings

GOLF BALL

BACKGROUND OF THE INVENTION

The present invention relates to a solid golf ball, and more particularly to a solid golf ball prepared from a rubber composition containing zinc acrylate coated with a higher fatty acid.

Golf balls are classified into two large groups, i.e. a solid golf ball and a wound golf ball. As a solid golf ball, there are known a one piece golf ball of a single structure, a two piece golf ball consisting of a solid core covered with a cover, and a golf ball of a multi-layer structure having three or more layers wherein an intermediate layer is provided between a core and a cover.

In general, a one piece golf ball and a core of a solid golf ball are prepared by heat pressure molding of a rubber composition containing a polybutadiene rubber, a radical initiator as a crosslinking or curing agent, e.g. a peroxide such as dicumyl peroxide, a metal salt of an unsaturated carboxylic acid as a co-crosslinking agent and zinc oxide used for controlling the weight of the golf ball. The unsaturated carboxylic acid metal salt is polymerized by means of the radical initiator such as a peroxide to produce hard reinforcing particles and link the reinforcing phase to the elastomeric phase by causing graft copolymerization of the monomer onto the polybutadiene in the interfacial region. Zinc acrylate has been preferably employed as a metal salt of unsaturated carboxylic acid.

Zinc acrylate is employed generally in a large quantity, for instance, 15 to 60 parts by weight per 100 parts by weight of polybutadiene rubber. Accordingly, zinc acrylate remarkably sticks to the roll surface upon kneading the rubber composition, thus the roll workability is remarkably lowered. Also, since zinc acrylate is easy to form agglomerates in the composition and poor in dispersibility, it is not effectively utilized. Consequently, the hardness of the ball becomes unexpectedly low or the impact resilience is not raised to the desired value, and the sound and feeling of striking the ball are bad.

It is an object of the present invention to provide a solid golf ball having a proper hardness, a good impact resilience, and good sound and feeling of striking.

Another object of the present invention is to provide a rubber composition suitable for preparing a one piece solid golf ball or a solid core for a solid golf ball and having a good processability such as roll workability and dispersibility of rubber additives.

These and other objects of the present invention will become apparent from the description hereinafter.

SUMMARY OF THE INVENTION

It has now been found that the above-mentioned objects can be attained by using, as a co-crosslinking agent, zinc acrylate particles surface-treated with a higher fatty acid to cover or coat the particle surface therewith.

In accordance with the present invention, there is provided a solid golf ball which is prepared by curing a rubber composition comprising a rubber, a zinc acrylate coated with a higher fatty acid and a solid golf ball rubber additive.

DETAILED DESCRIPTION

The rubber composition containing, as a co-crosslinking agent, zinc acrylate coated with a higher fatty acid according to the present invention is applicable to the preparation of a one piece golf ball and a solid core for a two piece golf ball and a multi-layer structured golf ball having three or more layers. Accordingly, the term "golf ball" as used in the specification and claims includes a one piece solid golf ball, a two piece solid golf ball having a core prepared from the rubber composition of the invention, and a multi-layer structured solid golf ball having a core prepared from the rubber composition of the invention and having at least one intermediate layer between the core and a cover.

Examples of the higher fatty acid used for coating the zinc acrylate powder are, for instance, lauric acid, stearic acid, palmitic acid, myristic acid, and the like. Usually, the higher fatty acid is selected from those having 12 to 18 carbon atoms. The higher fatty acids may be employed alone or in admixture thereof.

Methods for coating or covering zinc acrylate with a higher fatty acid are not particularly limited. For instance, the zinc acrylate particles are treated with a higher fatty acid such as stearic acid by dissolving the higher fatty acid in an organic solvent such as toluene, xylene, benzene, n-hexane or methanol, admixing the zinc acrylate particles with the solution to form a slurry and removing the solvent from the slurry, thus coating the surfaces of the zinc acrylate particles with the higher fatty acid. Also, in case of producing zinc acrylate by the reaction of acrylic acid and zinc oxide in an organic solvent, the coating may be successively conducted by utilizing the reaction mixture without isolating the produced zinc acrylate.

The amount of the higher fatty acid coated onto the zinc acrylate powder is preferably from 5 to 15% by weight based on the zinc acrylate. When the coating amount of the higher fatty acid is less than 5% by weight, the roll workability of a rubber composition and the dispersibility of zinc acrylate are not improved. When the coating amount is more than 15% by weight, zinc acrylate is apt to stick to a roll, thus the roll workability is lowered, and also the characteristics of the obtained golf ball are lowered.

The coated zinc acrylate is applicable as a co-crosslinking agent to any known rubber compositions for one piece golf balls and cores for solid golf balls. The coated zinc acrylate is employed as a co-crosslinking agent in an amount of 15 to 60 parts by weight per 100 parts by weight of a rubber. A polybutadiene rubber, especially cis-1,4-butadiene rubber, is preferably employed as a rubber component. Usual solid golf ball rubber additives may be incorporated into the rubber in addition to the coated zinc acrylate. The rubber composition usually contains a metal oxide such as zinc oxide or magnesium oxide used for controlling the weight of the obtained golf ball, a radical initiator, e.g. a peroxide such as dicumyl peroxide, as a crosslinking or curing agent, and other additives such as an antioxidant. In a preferable embodiment, the composition contains 100 parts by weight of a polybutadiene rubber, 15 to 60 parts by weight of the zinc acrylate coated with a higher fatty acid, 10 to 60 parts by weight of zinc oxide and 1 to 5 parts by weight of a radical initiator. A filler such as barium sulfate, calcium carbonate and silica may also be incorporated in the composition.

The rubber composition is kneaded by a suitable kneader, mixer or blender such as a roll mill or a Banbury mixer, and is molded in a mold, for instance, by heat pressure molding.

A one piece golf ball is prepared by heat-pressure molding the rubber composition of the present invention into a ball having a size suited for golf ball. A two piece golf ball and a multi-layer structured golf ball having three or more layers are also prepared in a usual manner. For instance, the two piece golf ball is prepared by heat-pressure molding the rubber composition of the present invention in a mold for core having suitable size to form a solid core, and covering the core with a suitable cover. The multi-layer structured golf ball is prepared by forming a solid core from the rubber composition of the invention, providing at least one intermediate layer on the core and covering the intermediate layer with a suitable cover. The cover can be prepared from known cover compositions, e.g. a composition comprising an ionomer resin as a main component and optionally a filler or coloring agent such as titanium dioxide or zinc oxide. Methods for covering the solid core or the intermediate layer on the core with a cover material are not particularly limited, but known methods are adoptable. Usually, the solid core or the intermediate layer is covered with two covers previously molded in the form of a hemispherical shell, and it is then molded under pressure to fuse two half shells together, for instance, at about 170° C. for 2 minutes, to give a finished golf ball. A method in which a cover composition is injection molded directly around the solid core or the intermediate layer is also adoptable.

The present invention is more specifically described and explained by means of the following Examples in which all parts are by weight.

Also, the following Reference Examples are presented to illustrate the preparation of zinc acrylate coated with a higher fatty acid used as a co-crosslinking agent in the present invention.

REFERENCE EXAMPLE 1

A 5 liter vertical mixer with a jacket was charged with 600 g. of zinc oxide and 2,000 ml. of toluene, and zinc oxide was suspended in toluene with stirring. After adding dropwise 1,060 g. of acrylic acid to the mixer over 30 minutes, the reaction was carred out at ordinary temperature for 60 minutes with stirring.

After the completion of the reaction, a solution of 130 g. of stearic acid (industrial grade) dissolved at a temperature of 45° to 50° C. in 100 ml. of toluene was added to the reaction mixture and stirred for 30 minutes to form a slurry. The produced water and toluene were removed from the slurry at 50° C. under reduced pressure of 60 to 120 mmHg for 3 hours to give 1,620 g. of a non-moisture-absorptive zinc acrylate coated with stearic acid. The amount of stearic acid coated onto zinc acrylcate was about 8.0% by weight based on zinc acrylate.

REFERENCE EXAMPLE 2

A 5 liter glass flask equipped with a stirrer, a dropping funnel and a condenser was charged with 360 g. of zinc oxide and 3,000 ml. of xylene, and zinc oxide was suspended in xylene. After adding dropwise 634 g. of acrylic acid to the flask over 30 minutes with stirring, the reaction was carried out at a temperature of 75° to 80° C. for 4 hours. After the completion of the reaction, the reaction mixture was taken out from the flask, and the product was filtered by a vacuum filter and dried by a hot air at 50° C. to decrease the volatile content to less than 0.5% by weight.

The product was placed in a kneader with a jacket. A solution of 69.5 g. of stearic acid dissolved at a temperature of 40° to 50° C. in 450 ml. of xylene was added to the kneader, and the content was stirred for 30 minutes. The thus formed slurry was heated for 2 hours under reduced pressure of 150 to 50 mmHg to distil away xylene by passing steam through the jacket, and the drying was further continued to give 944 g. of zinc acrylate coated with stearic acid. The amount of stearic acid coated onto zinc acrylate was about 8.5% by weight based on zinc acrylate.

EXAMPLE 1 AND COMPARATIVE EXAMPLE 1

The roll workability and the dispersibility into a rubber were estimated by employing a composition consisting of polybutadiene rubber and 30 parts of either one of the coated zinc acrylate obtained in Reference Example 1 or a conventional non-coated zinc acrylate per 100 parts of the rubber.

The non-coated zinc acrylate remarkably adhered to the roll surface, thus the roll working was very difficult. Moreover, the dispersibility of the non-coated zinc acrylate into the rubber was bad, because it formed agglomerates. In contrast, the coated zinc acrylate had good roll workability and dispersibility without forming agglomerates.

A composition containing the coated zinc acrylate obtained in Reference Example 1 and a composition containing the non-coated zinc acrylate were prepared according to the formulations shown in Table 1 by kneading the ingredients by a roll mill, and one piece solid golf balls having a diameter of about 41.2 mm. were formed by molding the compositions in a mold at 145° C. for 20 minutes under pressure. The resilience and hardness of the obtained balls were measured. The resilience was estimated by a ratio of a rebound velocity to an initial velocity when a ball was propelled out of a compressed air gun at an initial velocity of 45 m./sec. to a steel plate to rebound back. The hardness was estimated by the amount of deformation (mil) obtained by subtracting the strain when a load 3.8 kg. is applied from the strain when a load 45.4 kg. is applied.

The results are shown in Table 2.

TABLE 1

| Ingredients (part) | Ex. 1 | Com. Ex. 1 |
|---|---|---|
| Polybutadiene rubber | 100 | 100 |
| Coated zinc acrylate | 30 | — |
| Non-coated zinc acrylate | — | 30 |
| Zinc oxide | 55 | 55 |
| Antioxidant | 0.5 | 0.5 |
| Dicumyl peroxide | 1.5 | 1.5 |

TABLE 2

| | Resilience | Hardness |
|---|---|---|
| Example 1 | 0.738 | 52.0 |
| Comparative Example 1 | 0.709 | 77.3 |

As shown in Table 2, the use of the coated zinc acrylate provides a golf ball having an improved resilience. Also, the hardness of the ball was proper and the ball characteristics such as click and feeling of striking were good.

Also, the composition of Example 1 had a good roll workability and was smoothly kneaded. Further, it was confirmed by X-ray diffractiometry of the kneaded compositions that the coated zinc acrylate and the non-coated zinc acrylate both were in the form of normal salt.

Two kinds of solid cores having a diameter of 38.0 mm. were then prepared by molding the rubber compositions shown in Table 1 in a mold at 145° C. for 15 minutes under pressure. Two half shells were formed from a cover composition consisting of 100 parts of an ionomer resin (commercially available under the trademark "Surlyn 1601" made by the E. I. DuPond de Nomours Company) and 2 parts of titanium dioxide. They were positioned around each of the cores and subjected to compression molding at about 170° C. for 2 minutes to give a two piece solid golf ball having a diameter of 41.2 mm. The golf ball obtained from the composition of Example 1 had a good resilience, i.e. 0.759, and good sound and feeling of striking as compared with the golf ball obtained from the composition of Comparative Example 1 of which the resilience was 0.736.

EXAMPLE 2

With respect to the coated zinc acrylate obtained in Reference Example 2, the roll workability and the dispersibility into a rubber were estimated in the same manner as in Example 1. The roll workability and the dispersibility were good.

A one piece solid golf ball having a diameter of about 41.2 mm. was prepared in the same manner as in CExample 1 except that the coated zinc acrylate obtained in Reference Example 2 was employed. The ball had a hardness of 52.5 and a resilience of 0.735.

A two piece solid golf ball having a diameter of 41.2 mm. was then prepared in the same manner as in Example 1 except that the coated zinc acrylate obtained in Reference Example 2 was employed in the core composition. The ball had a resilience of 0.758 and good sound and feeling of striking.

In addition to the ingredients used in the Examples, other ingredients can be used in the Examples as set forth in the specification to obtain substantially the same results.

What we claim is:

1. A solid golf ball comprising a cured rubber product which is prepared from a composition comprising a polybutadiene rubber and zinc acrylate particles coated with a higher fatty acid, the amount of the higher fatty acid coated on the zinc acrylate particles being 5 to 15% by weight based on the zinc acrylate.

2. The solid golf ball of claim 1, wherein said higher fatty acid is stearic acid.

3. The solid golf ball of claim 1, wherein the cured rubber product which is prepared from a composition which comprises 100 parts by weight of a polybutadiene rubber, 15 to 60 parts by weight of the zinc acrylate coated with the higher fatty acid, 10 to 60 parts by weight of zinc oxide and 1 to 5 parts by weight of a radical initiator.

* * * * *